US009259064B1

(12) United States Patent
Chen et al.

(10) Patent No.: US 9,259,064 B1
(45) Date of Patent: Feb. 16, 2016

(54) OPENING/CLOSING STRUCTURE FOR AN AUTOMATIC UMBRELLA

(71) Applicant: XIAMEN MINGHE INDUSTRY CO., LTD., Fujian (CN)

(72) Inventors: Tien-Cheng Chen, Fujian (CN); Sun-Feng Sung, Fujian (CN)

(73) Assignee: Xiamen Minghe Industry Co., Ltd., Fujian (CN)

( * ) Notice: Subject to any disclaimer, the term of this patent is extended or adjusted under 35 U.S.C. 154(b) by 0 days.

(21) Appl. No.: 14/486,056

(22) Filed: Sep. 15, 2014

(51) Int. Cl.
*A45B 25/14* (2006.01)

(52) U.S. Cl.
CPC ..... *A45B 25/14* (2013.01); *A45B 25/143* (2013.01)

(58) Field of Classification Search
CPC ..... A45B 25/14; A45B 25/143
USPC ..... 135/20.3, 22, 24
See application file for complete search history.

(56) References Cited

U.S. PATENT DOCUMENTS

| | | | | |
|---|---|---|---|---|
| 3,870,062 | A * | 3/1975 | Medlin | 135/20.3 |
| 4,424,824 | A * | 1/1984 | Becher | 135/20.3 |
| 4,572,226 | A * | 2/1986 | Williams et al. | 135/22 |
| 5,291,908 | A * | 3/1994 | Grady, II | 135/22 |
| 6,543,464 | B1 * | 4/2003 | Grady, II | 135/22 |
| 7,562,666 | B2 * | 7/2009 | Chan | 135/20.3 |
| 7,909,049 | B2 * | 3/2011 | Yang et al. | 135/20.3 |
| 7,997,290 | B2 * | 8/2011 | Stoelinga | 135/20.3 |
| 8,757,183 | B2 * | 6/2014 | Volin | 135/20.3 |
| 8,857,453 | B2 * | 10/2014 | Souma | 135/20.3 |
| 2005/0166950 | A1 * | 8/2005 | Grady, II | 135/75 |
| 2006/0151019 | A1 * | 7/2006 | Lo | 135/20.3 |

* cited by examiner

*Primary Examiner* — Noah Chandler Hawk
(74) *Attorney, Agent, or Firm* — Alan D. Kamrath; Kamrath IP Lawfirm, P.A.

(57) ABSTRACT

An opening/closing structure for an automatic umbrella contains: a shaft assembly, a frame, a notch, a first runner, a second runner, a driving mechanism, and a handle. The shaft assembly includes a first tube and a second tube. The frame couples with the notch and the second runner. The driving mechanism includes a screw rod and a push post. The push post has a drive portion and inner threads. The push post is connected with the first tube by inserting a joining element into the second tube, and the second tube has a slot longitudinally formed on an outer wall thereof. The joining element moves upwardly or downwardly along the slot. The push post has the drive portion, a coupling portion, and a deforming portion. The deforming portion is sufficiently rigid to shaft itself in an axial direction and deforms and recovers its original shape in a torque direction.

8 Claims, 7 Drawing Sheets

OPENING/CLOSING STRUCTURE FOR AN AUTOMATIC UMBRELLA

BACKGROUND OF THE INVENTION

1. Field of the Invention

The present invention relates to an umbrella and, more particularly, to an opening/closing structure for an automatic umbrella which is opened and closed completely.

2. Description of the Prior Art

A conventional umbrella is employed to shield rains in a rainy day and contains a frame manually pushed to a certain position to expand the umbrella. To improve over manually expanding the umbrella, an automatic umbrella is developed and contains a button fixed on a handle to be pressed to expand the automatic umbrella automatically. However, such an automatic umbrella cannot be retracted automatically, i.e., the automatic umbrella is retracted manually, so a user will get wet during manually retracting the automatic umbrella.

However, when a driving structure drives a first tube to move upwardly relative to a second tube, a shaft assembly causes vibration, so a user cannot hold the automatic umbrella comfortably. In other words, when a screw rod of the driving mechanism drives a push post to move upwardly toward a complete opening position, inner threads on a lower end of the push post actuate the first tube to rotate relative to the second tube. Then, the shaft assembly vibrates after receiving a rotating force of the first tube, thus reducing the service life of the automatic umbrella.

The present invention has arisen to mitigate and/or obviate the afore-described disadvantages.

SUMMARY OF THE INVENTION

The primary objective of the present invention is to provide an opening/closing structure for an automatic umbrella which enhances comfort, avoids vibration, and prolongs service life of the automatic umbrella.

To obtain the above and other objectives, an opening/closing structure for an automatic umbrella provided by the present invention contains: a shaft assembly, a frame, a notch, a first runner, a second runner, a driving mechanism, and a handle in which a power source is configured.

The shaft assembly includes a first tube and a second tube. A length of the second tube is larger than that of the first tube. A lower end of the second tube is fixed on the handle. An upper end of the second tube matches with the notch. The first tube is fitted on the second tube to move between the notch and the handle on the second tube, and the second runner is fitted on the first tube.

The frame couples with the notch and the second runner.

The driving mechanism includes a screw rod and a push post for cooperating with the screw rod.

A lower end of the screw rod is joined with the power source in the handle.

The push post has a drive portion for matching with the screw rod and inner threads formed on the drive portion and screwing with the screw rod. Thus, the power source is started to drive the screw rod to rotate clockwise or counterclockwise, and the push post is driven by the screw rod to move upwardly or downwardly relative to the screw rod.

The push post is inserted into the second tub, and its upper end is connected with the first tube by inserting a joining element into the second tube. The second tube has a slot longitudinally formed on an outer wall thereof, such that the joining element moves upwardly or downwardly along the slot. The push post has the drive portion arranged on a lower end thereof to match with the screw rod, a coupling portion formed on an upper end thereof, and a deforming portion connecting with the drive portion and the coupling portion. The deforming portion is sufficiently rigid to shaft itself in an axial direction and deforms and recovers its original shape in a torque direction.

Since the push post has three portions, and when the automatic umbrella is opened completely, the power source drives the screw rod to rotate relative to the drive portion. The drive portion is driven to rotate by ways of the deforming portion and the coupling portion, and the deforming portion deforms to resist against the drive portion. Thus, the coupling portion is not influenced by the drive portion, and the first tube moves stably, preventing vibration of the shaft assembly, enhancing comfort of the automatic umbrella, and prolonging service life of the automatic umbrella.

DETAILED DESCRIPTION OF THE PREFERRED EMBODIMENTS

Figure 1:
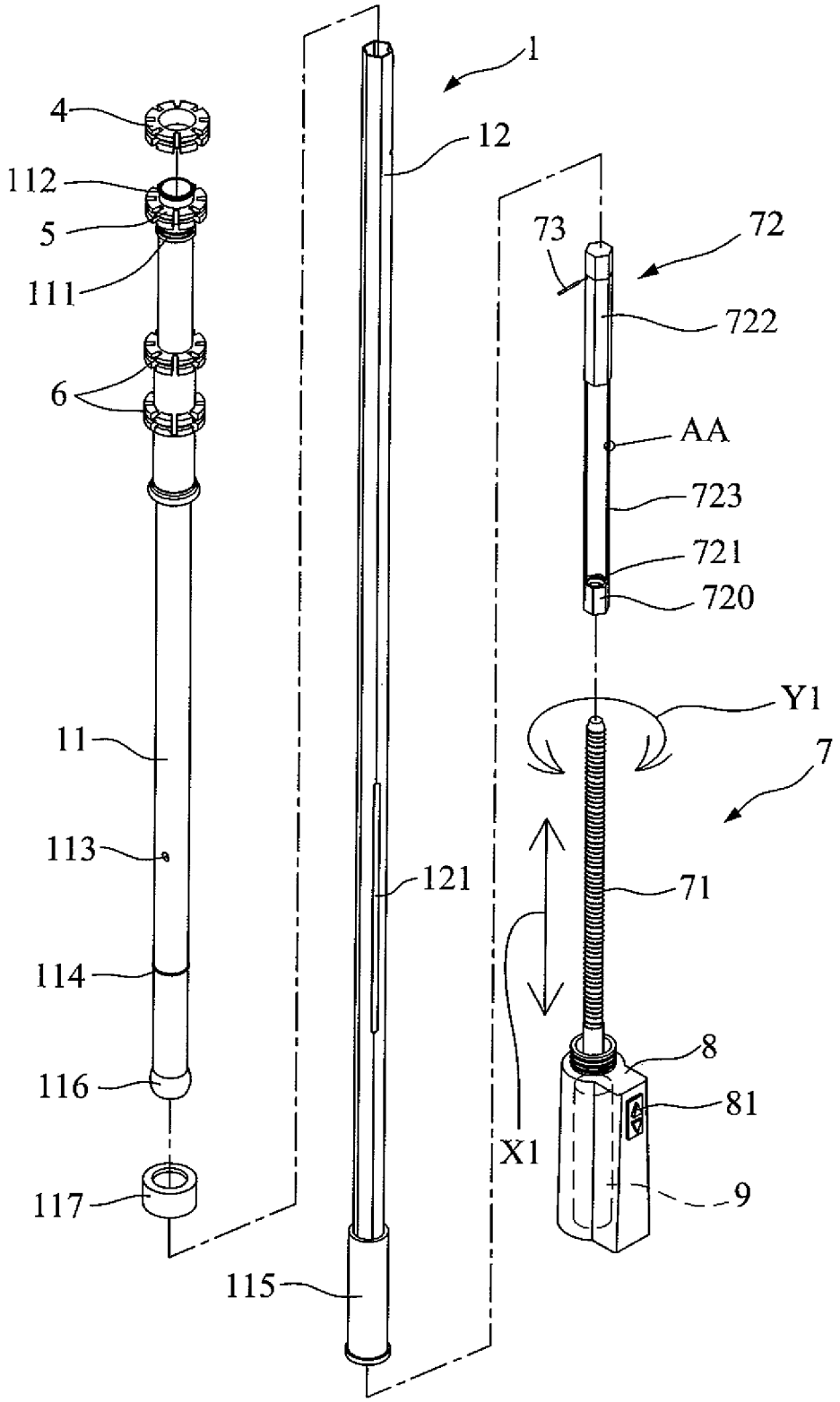
FIG. 1 is a perspective view showing the exploded components of a shaft assembly of an opening/closing structure for an automatic umbrella according to a preferred embodiment of the present invention.

The present invention will be clearer from the following description when viewed together with the accompanying drawings, which show, for purpose of illustration only, preferred embodiments in accordance with the present invention.

With reference to FIGS. 1-4, an automatic umbrella according to a preferred embodiment of the present invention comprises: a shaft assembly 1, a frame 2, an umbrella cloth (not shown) disposed on the frame 2, a notch 4, a first runner 6, a second runner 5, a driving mechanism 7, and a handle 8 in which a power source 8A is configured.

The frame 2 includes a plurality of ribs 21, plural first auxiliary stretchers 22, and plural second auxiliary stretchers 23. A first end of each rib 21 is connected with the notch 4, and a second end of each rib 21 is a free segment 211. A first end of each first auxiliary stretcher 22 is coupled with the second runner 5, and a second end of each first auxiliary stretcher 22 is joined with each rib 21. A first end of each second auxiliary stretcher 23 is in connection with the first runner 6, and a second end of each second auxiliary stretcher 23 is coupled with each rib 21. In addition, between the first runner 6 and each rib 21 is defined a spring 24.

Referring to FIG. 1, the shaft assembly 1 includes a first tube 11 and a second tube 12. A length of the second tube 12 is larger than that of the first tube 11. A lower end of the second tube 12 is fixed on the handle 8, and an upper end of the second tube 12 matches with the notch 4. The first tube 11 is fitted on the second tube 12 to move between the notch 4 and the handle 8 on the second tube 12, and the second runner 5 and the first runner 6 are fitted on the first tube 11. The first tube 11 has a limiting member 111 fixed thereon to limit the second runner 5 to move above the limiting member 111. In this embodiment, the limiting member 111 is a shoulder formed on the first tube 11, and the limiting member 111 is a stop ring or a bolt fitted on the first tube 11 in another embodiment. To avoid a removal of the second runner 5 from the first tube 11, and after the second runner 5 is fixed on the first tube 11, an anti-off member 112 is mounted on the first tube 11 and its structure is identical to that of the limiting member 111. Furthermore, the first tube 11 also has a connecting orifice 113 defined thereon.

The driving mechanism 7 includes a screw rod 71 and a push post 72 for cooperating with the screw rod 71. A lower end of the screw rod 71 is joined with the power source 8A in the handle 8. The push post 72 has a drive portion 720 for matching with the screw rod 71 and inner threads 721 formed on the drive portion 720 and screwing with the screw rod 71, such that the power source 8A is started to drive the screw rod 71 to rotate clockwise or counterclockwise. Then, the push post 72 is driven by the screw rod 71 to move upwardly or downwardly relative to the screw rod 71. The push post 72 is inserted into the second tube 12, so that its upper end is connected with the first tube 11 by inserting a joining element 73 into the second tube 12 and the connecting orifice 113, and the second tube 12 has a slot 121 longitudinally formed on an outer wall thereof, so that the joining element 73 moves upwardly or downwardly along the slot 121.

Figure 5:
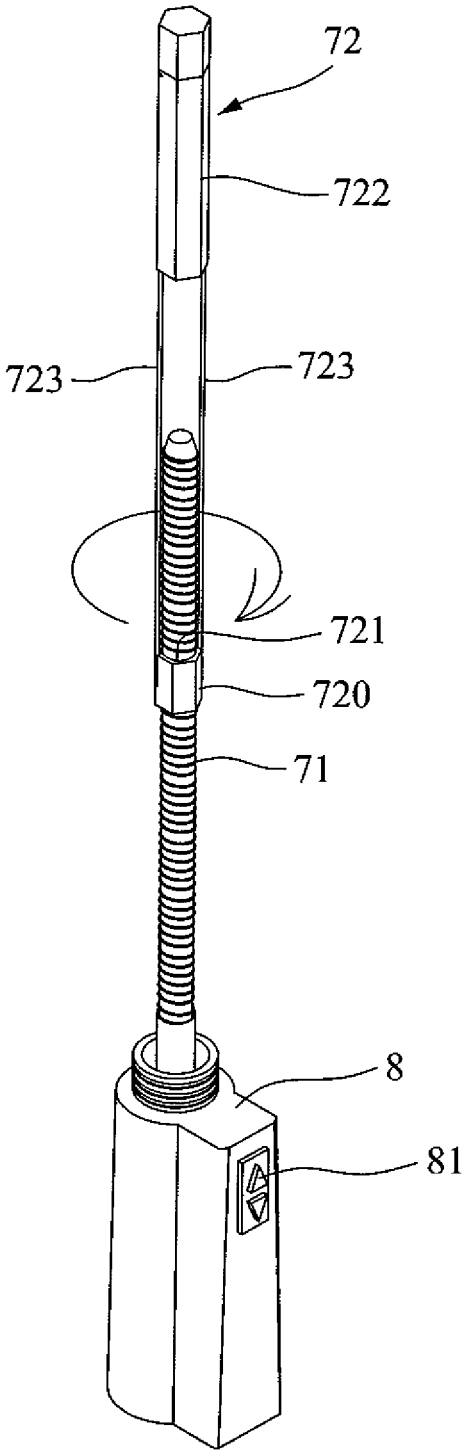
FIG. 5 is a perspective view showing the operation of a screw rod and a push post of the opening/closing structure for the automatic umbrella according to the preferred embodiment of the present invention.
Figure 6:
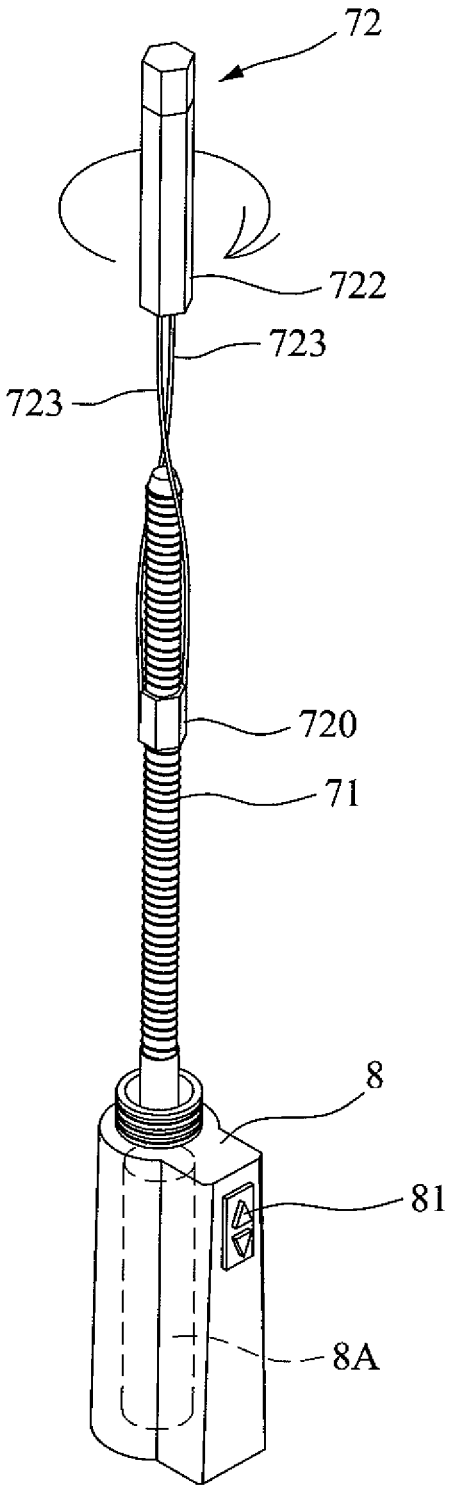
FIG. 6 is another perspective view showing the operation of the screw rod and the push post of the opening/closing structure for the automatic umbrella according to the preferred embodiment of the present invention.

It is to be noted that the push post 72 has the drive portion 720 arranged on a lower end thereof to match with the screw rod 71, a coupling portion 722 formed on an upper end thereof, and a deforming portion 723 connecting with the drive portion 720 and the coupling portion 722. The coupling portion 722 cooperates with an inner wall of the second tube 12 and is coupled with the first tube 11 by inserting the joining element 73 into the first tube 11. The deforming portion 723 is any one of a sufficiently rigid piece, at least two sufficiently rigid cables which are symmetrically arranged, and plural sufficiently rigid cables equidistantly arranged between the drive portion 720 and the coupling portion 722. Two ends of each sufficiently rigid cable are joined with the drive portion 720 and the coupling portion 722. The deforming portion 723 is sufficiently rigid to shaft itself in an axial direction X1 and deforms and recovers its original shape in a torque direction Y1. As shown in FIG. 5, the screw rod 71 actuates the push post 72 to rotate. As illustrated in FIG. 6, the screw rod 71 stops actuating the push post 72. Then, the deforming portion 723 stops deformation to maintain a pushing force of the push post 72 stably and to avoid structural impact. It is to be noted that a longitudinal moving stoke of the inner threads 721 along the screw rod 71 is a longitudinal moving stoke of the second runner 5 relative to the second tube 12.

The handle 8 is formed in a cover shape to accommodate the power source 8A and includes a control button 81 for starting the power source 8A to rotate clockwisely or counterclockwisely. The power source 8A is a speed change gear or a motor.

Figure 3:
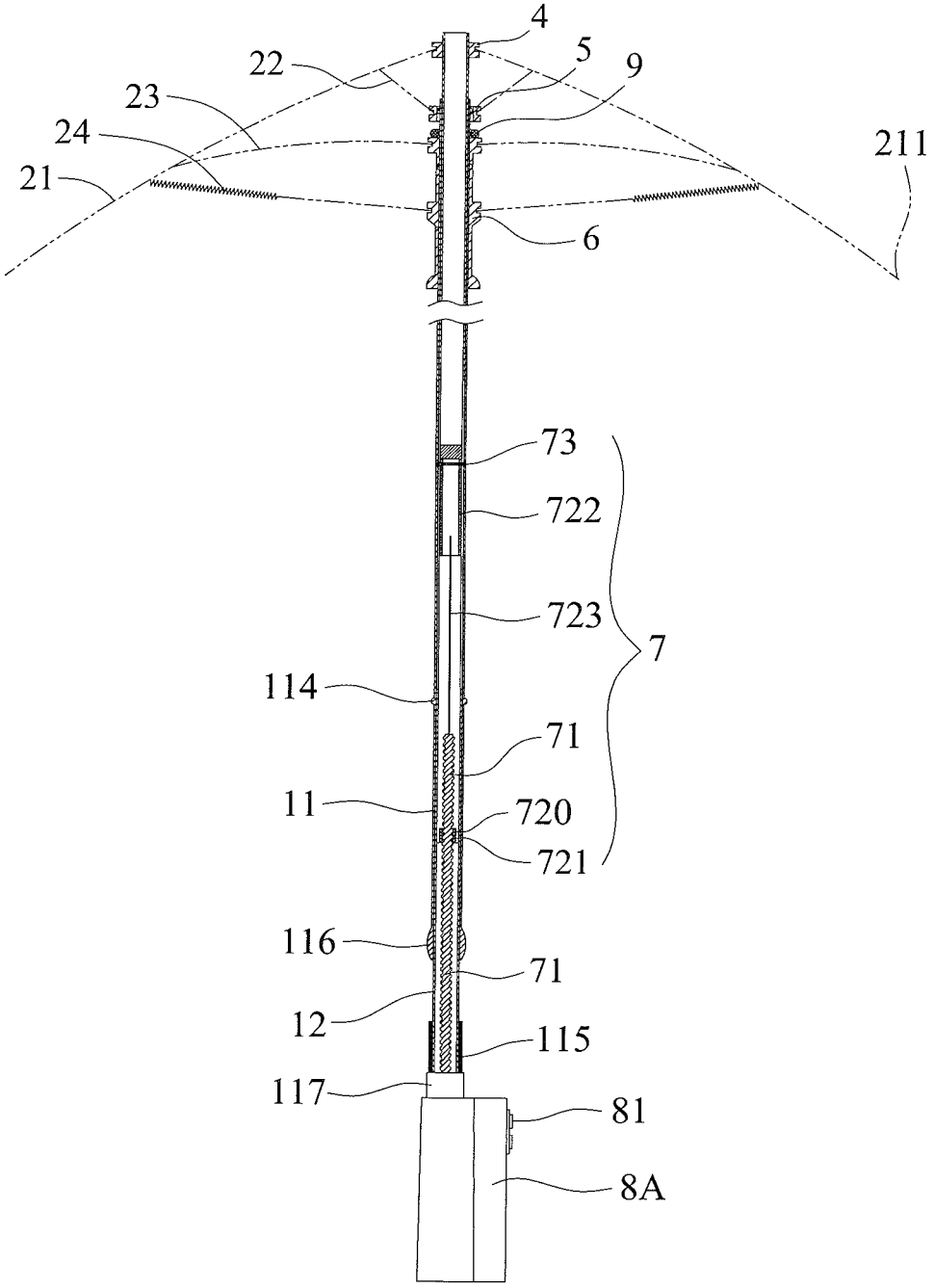
FIG. 3 is another cross sectional view showing the assembly of the opening/closing structure for the automatic umbrella according to the preferred embodiment of the present invention.

With reference to FIG. 3, when the automatic umbrella is closed, the drive portion 720 is located at the lower end of the screw rod 71, i.e., the push post 72 is located at the lower end of the screw rod 71 relative to the second tube 12.

Figure 2:
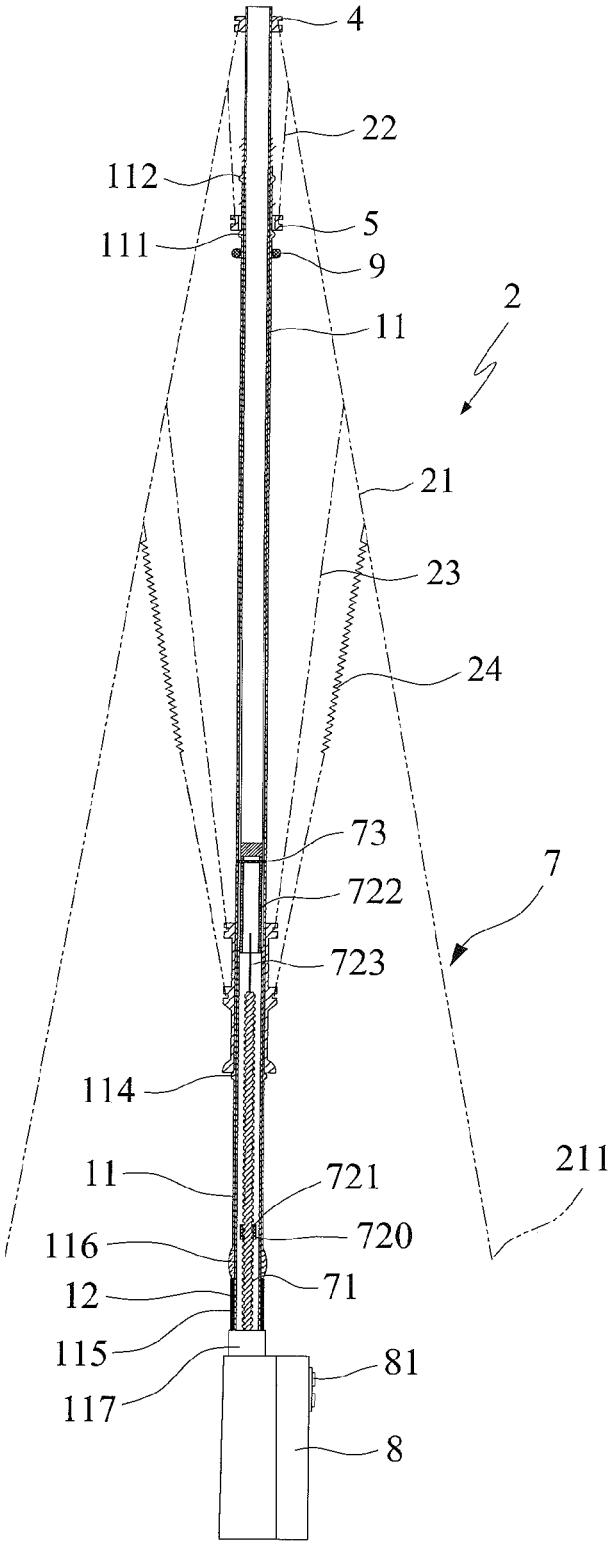
FIG. 2 is a cross sectional view showing the assembly of the opening/closing structure for the automatic umbrella according to the preferred embodiment of the present invention.

Referring to FIG. 2, when the automatic umbrella is opened, the power source 8A is started to output a clockwise rotating force by which the screw rod 71 is driven to rotate. The drive portion 720 moves upwardly along the screw rod 71, and the deforming portion 723 pushes the coupling portion 722 to drive the first tube 11. Then, the first tube 11 moves upwardly relative to the second tube 12, and the limiting member 111 simultaneously pushes the second runner 5 to move upwardly, such that the plurality of first auxiliary stretchers 22 push the plurality of ribs 21 to expand outwardly, and such that the plurality of ribs 21 drive the second auxiliary stretchers 23 to expand upwardly and actuate the first runner 6 to move upwardly toward an upper end of the first tube 11, thus opening the automatic umbrella completely. The second runner 5 drives the plurality of first auxiliary stretchers 22 to expand the plurality of ribs 21 of the frame 2. Thereafter, plural springs 24 pull the plurality of ribs 21, and the umbrella cloth forces the frame 2. Thus, an angle forms between the frame 2 and the plurality of second auxiliary stretchers 23, thereby stopping an upward movement of the first runner 6.

To obtain aesthetics appearance of the shaft assembly 1, a protective sleeve 116 is covered on a lower end of the first tube 11. Moreover, a buffer pad 9 is defined between the second runner 5 and the first runner 6 to buffer an impact force between the second runner 5 and the first runner 6, when the first runner 6 is pulled upwardly toward the second runner 5. When closing the automatic umbrella, a protrusion 114 is disposed on the lower end of the first tube 11 and its outer diameter is larger than an inner diameter of the first runner 6. When the automatic umbrella is opened, the protrusion 114 acts on the first runner 6, thus opening the automatic umbrella easily. Between the lower end of the second tube 12 and the handle 8 are fitted a protective fitting 115 and a fixing loop 117 for fixing the protective fitting 115 on the handle 8 tightly.

Figure 4:
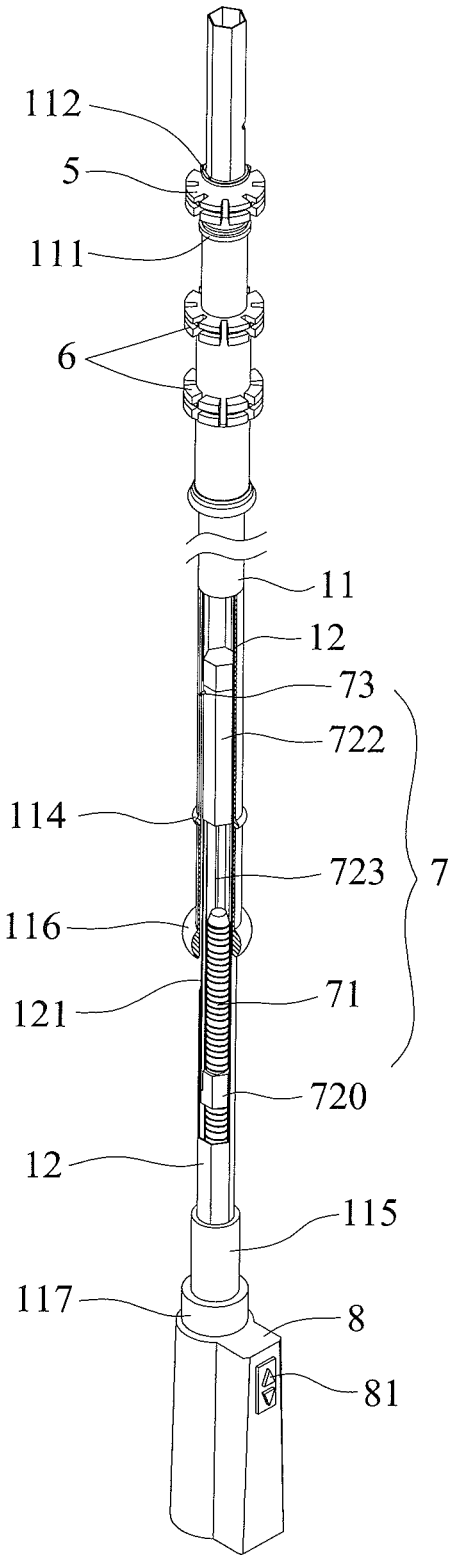
FIG. 4 is a perspective cross sectional view showing the assembly of a shaft assembly of the opening/closing structure for the automatic umbrella according to the preferred embodiment of the present invention.

As shown in FIG. 4, when the automatic umbrella is opened completely, the power source 8A drives the screw rod 71 to rotate relative to the drive portion 720. Since the push post 72 has three portions, the drive portion 720 rotates by ways of the deforming portion 723 and the coupling portion 722, and the deforming portion 723 deforms to resist against the drive portion 720 in the torque direction Y1. Thus, the coupling portion 722 is not influenced by the drive portion 720, the push post 72 moves in the axial direction X1, and the first tube 11 moves stably, thus preventing vibration of the shaft assembly 1, enhancing comfort of the automatic umbrella, and prolonging service life of the automatic umbrella.

Figure 1A:
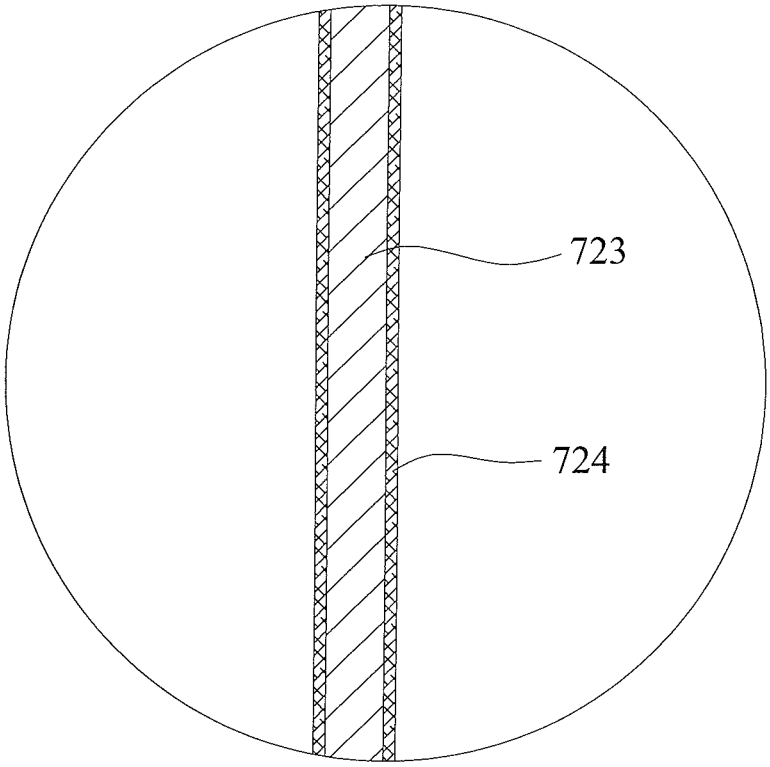
FIG. 1A is an amplified cross-sectional view of a part of a portion AA of FIG. 1 according to the preferred embodiment of the present invention.

As shown in FIG. 1A, when the deforming portion 723 is at least two sufficiently rigid cables, a sound eliminating layer 724 is fitted on the deforming portion 723. Thereby, the deforming portion 723 does not hit the second tube 12 to make noise. Preferably, the sound eliminating layer 724 is a rubber sleeve or other flexible casing.

While various embodiments in accordance with the present invention have been shown and described, it is clear to those skilled in the art that further embodiments may be made without departing from the scope of the present invention.

What is claimed is:

1. An opening/closing structure for an automatic umbrella comprising: a shaft assembly, a frame, a notch, a first runner, a driving mechanism, and a handle in which a power source is configured;

with the shaft assembly including a first tube and a second tube, with a length of the second tube being larger than that of the first tube, with a lower end of the second tube fixed on the handle, with an upper end of the second tube matching with the notch, with the first tube fitted on the second tube to move between the notch and the handle on the second tube, and with the first runner being fitted on the first tube;

with the frame coupling with the notch and the first runner; and with the driving mechanism including a screw rod and a push post for cooperating with the screw rod; wherein:

a lower end of the screw rod is joined with the power source in the handle;

the push post has a drive portion for matching with the screw rod and inner threads formed on the drive portion and screwing with the screw rod;

the power source drives the screw rod to rotate clockwise or counterclockwise;

the push post is driven by the screw rod to move upwardly or downwardly relative to the screw rod;

the push post is inserted into the second tube and an upper end of the push post is connected with the first tube by inserting a joining element into the second tube;

the second tube has a slot longitudinally formed on an outer wall thereof;

the joining element moves upwardly or downwardly along the slot;

the push post has the drive portion arranged on a lower end thereof to match with the screw rod, a coupling portion formed on an upper end thereof, and a deforming portion connecting with the drive portion and the coupling portion; and the deforming portion is sufficiently rigid to shaft itself in an axial direction and deforms and recovers an original shape in a torque direction.

2. The opening/closing structure for the automatic umbrella as claimed in claim 1 further comprising a second runner, with the frame including a plurality of ribs, plural first auxiliary stretchers, and plural second auxiliary stretchers; wherein a first end of each rib is connected with the notch, and a second end of each rib is a free segment; wherein a first end of each first auxiliary stretcher is coupled with the second runner, and a second end of each first auxiliary stretcher is joined with each rib; wherein a first end of each second auxiliary stretcher is in connection with the first runner, and a second end of each second auxiliary stretcher is coupled with each rib; and wherein between the first runner and each rib is defined a spring.

3. The opening/closing structure for the automatic umbrella as claimed in claim 2, wherein the first tube has a limiting member fixed thereon to limit the second runner to move above the limiting member.

4. The opening/closing structure for the automatic umbrella as claimed in claim 1, wherein the deforming portion is a sufficiently rigid piece.

5. The opening/closing structure for the automatic umbrella as claimed in claim 1, wherein the deforming portion is at least two sufficiently rigid cables which are symmetrically arranged, and wherein two ends of each sufficiently rigid cable are joined with the drive portion and the coupling portion.

6. The opening/closing structure for the automatic umbrella as claimed in claim 1, wherein the deforming portion is plural sufficiently rigid cables equidistantly arranged between the drive portion and the coupling portion, and wherein two ends of each sufficiently rigid cable are joined with the drive portion and the coupling portion.

7. The opening/closing structure for the automatic umbrella as claimed in claim 1, wherein the frame includes a plurality of ribs and plural auxiliary stretchers; wherein a first end of each rib is connected with the notch, and a second end of each rib is a free segment; and wherein a first end of each auxiliary stretcher is coupled with the second runner, and a second end of each auxiliary stretcher is joined with each rib.

8. The opening/closing structure for the automatic umbrella as claimed in claim 1, wherein the first tube has a protective sleeve covered on a lower end thereof; and wherein a buffer pad is defined between the second runner and the first runner.

* * * * *